US010710133B2

(12) United States Patent
Shimoda et al.

(10) Patent No.: US 10,710,133 B2
(45) Date of Patent: Jul. 14, 2020

(54) TEMPERATURE CALCULATION METHOD, TEMPERATURE CALCULATION APPARATUS, HEATING CONTROL METHOD, AND HEATING CONTROL APPARATUS

(71) Applicant: TOSHIBA MITSUBISHI-ELECTRIC INDUSTRIAL SYSTEMS CORPORATION, Chuo-ku (JP)

(72) Inventors: Naoki Shimoda, Tokyo (JP); Haruki Inami, Tokyo (JP); Mirei Kihara, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 394 days.

(21) Appl. No.: 15/557,918

(22) PCT Filed: Mar. 26, 2015

(86) PCT No.: PCT/JP2015/059433

§ 371 (c)(1),
(2) Date: Sep. 13, 2017

(87) PCT Pub. No.: WO2016/151854

PCT Pub. Date: Sep. 29, 2016

(65) Prior Publication Data

US 2018/0043407 A1 Feb. 15, 2018

(51) Int. Cl.
*B21B 37/76* (2006.01)
*C21D 8/02* (2006.01)
(Continued)

(52) U.S. Cl.
CPC ..... *B21B 37/76* (2013.01); *C21D 8/0205* (2013.01); *C21D 8/0226* (2013.01); *C21D 11/00* (2013.01); *B21B 37/74* (2013.01)

(58) Field of Classification Search
CPC ..... B21B 37/76
(Continued)

(56) References Cited

U.S. PATENT DOCUMENTS 5,891,275 A * 4/1999 Elfmark ..... C21D 9/573 148/511
2010/0332015 A1* 12/2010 Weinzierl ..... B21B 37/76 700/153

(Continued)

FOREIGN PATENT DOCUMENTS

JP 2012-148310 A 8/2012
JP 5391205 B2 1/2014

OTHER PUBLICATIONS

International Search Report dated Apr. 21, 2015 in PCT/JP2015/059433, filed Mar. 26, 2015.

*Primary Examiner* — Ricky Ngon
(74) *Attorney, Agent, or Firm* — Xsensus LLP

(57) ABSTRACT

A temperature calculation method includes: dividing a cross section perpendicular to a longitudinal direction of a steel plate to be hot-rolled into a plurality of rectangular elements; and calculating a temperature of each of the rectangular elements using a finite difference method. A first region 31 that includes an edge part of the cross section is divided such that a plurality of the rectangular elements are lined up in a plate-thickness direction and such that a plurality of the rectangular elements are lined up in a plate-width direction. A second region 32 that includes a center of the cross section and is wider than the first region 31 is divided such that a plurality of the rectangular elements are lined up in the plate-thickness direction but the second region 32 is not divided in the plate-width direction.

10 Claims, 6 Drawing Sheets

(51) Int. Cl.
*C21D 11/00* (2006.01)
*B21B 37/74* (2006.01)

(58) Field of Classification Search
USPC ..... 702/130
See application file for complete search history.

(56) References Cited

U.S. PATENT DOCUMENTS

2011/0247381 A1* 10/2011 Shimoda ..... B21B 37/74
72/12.2
2012/0247625 A1* 10/2012 Shimamura ..... C21D 8/0226
148/654
2013/0030561 A1* 1/2013 Imanari ..... B21B 37/76
700/153

* cited by examiner

TEMPERATURE CALCULATION METHOD, TEMPERATURE CALCULATION APPARATUS, HEATING CONTROL METHOD, AND HEATING CONTROL APPARATUS

TECHNICAL FIELD

The present invention relates to a temperature calculation method, a temperature calculation apparatus, a heating control method, and a heating control apparatus.

BACKGROUND ART

In hot rolling, a state of phase transformation changes in accordance with temperature history of a steel plate and, accordingly, mechanical properties such as strength of a final product vary. Thus, it is extremely important to manage a temperature of each part of a steel plate. PTL 1 below discloses an apparatus which calculates a temperature distribution of a cross section perpendicular to a longitudinal direction of a steel plate in hot rolling. The apparatus described in PTL 1 annularly divides a steel plate in spatial increments into a plurality of elements from an outer periphery to a center of a cross section of the steel plate and calculates a predicted temperature of each divided element by a difference method.

With a steel plate in hot rolling, a temperature of an edge part is likely to be lower than a temperature of a central part in a plate-width direction. In some cases, an edge heater is provided on a rolling line as equipment for correcting low temperature of an edge part. An edge heater heats only the edge part of a steel plate with induction heating.

PTL 2 below discloses a method of calculating an amount of lost heat from an edge part by air cooling, a coolant, and roll contact between an edge heater and a rolling mill and correcting an amount of applied heat by the edge heater so that the edge part reaches a target temperature on an entry side of the rolling mill.

CITATION LIST

Patent Literature

[PTL 1] Japanese Patent No. 5391205

[PTL 2] Japanese Patent Application Laid-open No. 2012-148310

SUMMARY OF INVENTION

Technical Problem

The apparatus according to PTL 1 calculates a representative temperature of each divided annular element. An outermost element includes a top surface and a side surface of the steel plate. Thus, in a calculation result of the apparatus according to PTL 1, a temperature of the top surface and a temperature of the side surface of the steel plate are equal to one another. With the apparatus according to PTL 1, it is difficult to accurately calculate a temperature distribution of a steel plate when there is a large difference between a temperature in a vicinity of center in a plate-width direction and a temperature of an edge part of the steel plate.

The calculation of an amount of lost heat according to PTL 2 uses a simplified formula based on variables which affect the amount of lost heat such as coolant pressure and plate speed. Coefficients of the simplified formula must be empirically obtained. Thus, in order to increase calculation accuracy, experiments involving various steel grades and sizes must be performed to obtain the coefficients.

The present invention has been made in order to solve the problems described above. An object of the present invention is to provide a temperature calculation method, a temperature calculation apparatus, a heating control method, and a heating control apparatus which contribute toward improving quality of a hot-rolled steel plate including an edge part thereof while reducing calculation load.

Solution to Problem

A temperature calculation method according to the present invention includes: dividing a cross section perpendicular to a longitudinal direction of a steel plate to be hot-rolled into a plurality of rectangular elements; and calculating a temperature of each of the rectangular elements using a finite difference method. A first region that includes an edge part of the cross section is divided such that a plurality of the rectangular elements are lined up in a plate-thickness direction and such that a plurality of the rectangular elements are lined up in a plate-width direction. A second region that includes a center of the cross section and is wider than the first region is divided such that a plurality of the rectangular elements are lined up in the plate-thickness direction but the second region is not divided in the plate-width direction.

A heating control method according to the present invention includes: measuring a temperature difference between a representative temperature of the second region and a representative temperature of the first region at a position on a downstream of an edge heater configured to heat an edge part of the steel plate; calculating the temperature difference using the above temperature calculation method; and controlling power of the edge heater or an amount of applied heat of the edge heater, based on the measured value of the temperature difference, the calculated value of the temperature difference, and a target value of the temperature difference.

A temperature calculation apparatus according to the present invention includes: means for dividing a cross section perpendicular to a longitudinal direction of a steel plate to be hot-rolled into a plurality of rectangular elements; and means for calculating a temperature of each of the rectangular elements using a finite difference method. A first region that includes an edge part of the cross section is divided such that a plurality of the rectangular elements are lined up in a plate-thickness direction and such that a plurality of the rectangular elements are lined up in a plate-width direction. A second region that includes a center of the cross section and is wider than the first region is divided such that a plurality of the rectangular elements are lined up in a plate-thickness direction but the second region is not divided in the plate-width direction.

A heating control apparatus according to the present invention includes: the above temperature calculation apparatus; means for measuring a temperature difference between a representative temperature of the second region and a representative temperature of the first region at a position on a downstream of an edge heater configured to heat an edge part of the steel plate; means for calculating the temperature difference using the temperature calculation apparatus; and means for controlling power of the edge heater or an amount of applied heat by the edge heater, based on the measured value of the temperature difference, the calculated value of the temperature difference, and a target value of the temperature difference.

Advantageous Effects of Invention

According to the present invention, a temperature distribution of a hot-rolled steel plate can be accurately calculated including an edge part thereof and a contribution can be made toward improving quality of the steel plate including the edge part thereof.

DESCRIPTION OF EMBODIMENTS

Figure 1:
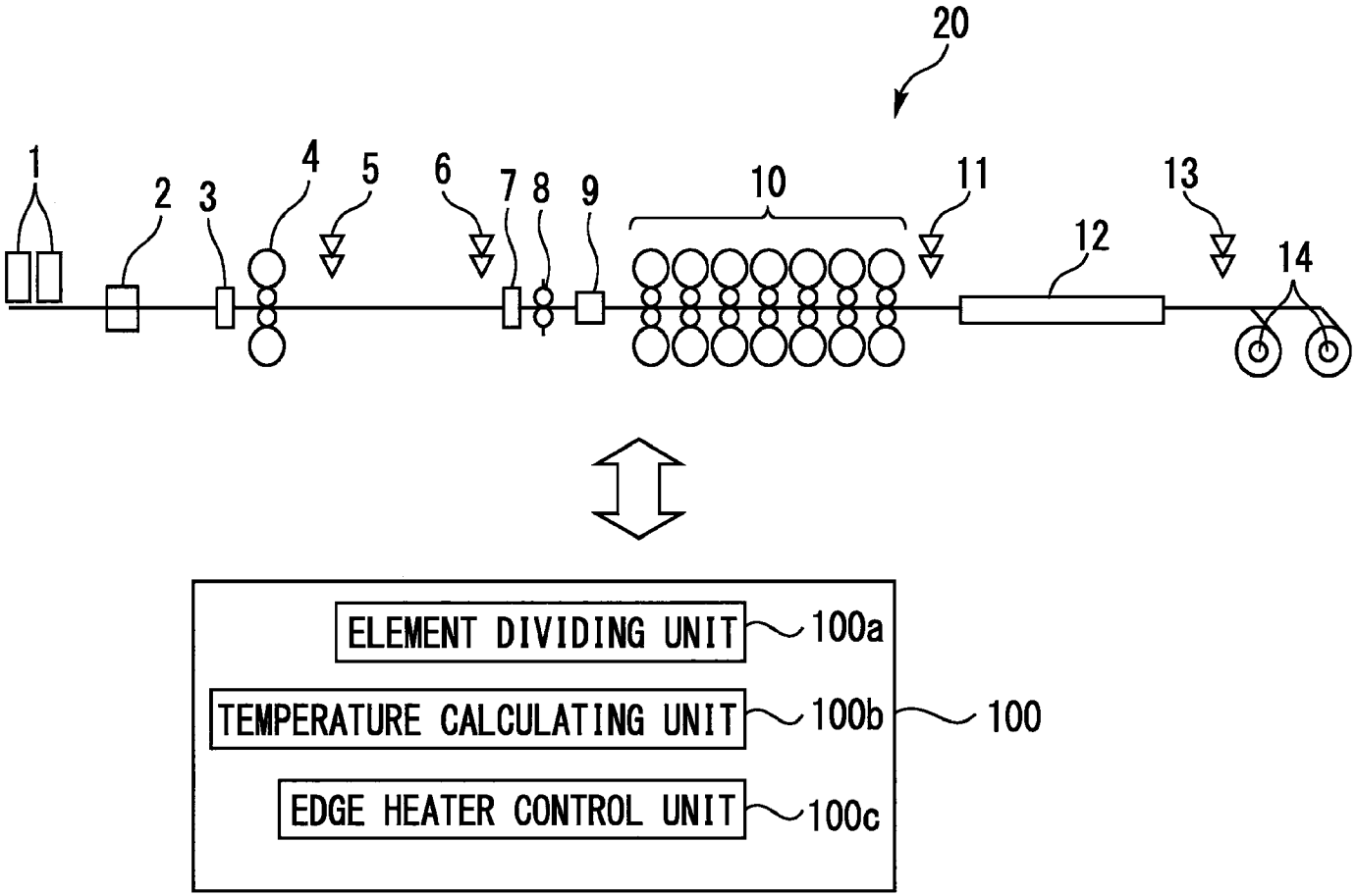
FIG. 1 is a configuration diagram showing a rolling system to which a first embodiment of the present invention is applied.

Hereinafter, embodiments of the present invention will be described with reference to the drawings. Note that common elements in the drawings are denoted by same reference signs and overlapping descriptions will be omitted.

First Embodiment

FIG. 1 is a configuration diagram showing a rolling system to which a first embodiment of the present invention is applied. A rolling system 20 shown in FIG. 1 includes a slab heating furnace 1, a high-pressure descaling apparatus 2, an edger 3, a roughing mill 4, a first thermometer 5, a second thermometer 6, an edge heater 7, a crop shear 8, an finishing-entry-side descaling apparatus 9, a finishing mill 10, a third thermometer 11, a runout laminar spray cooling apparatus 12, a fourth thermometer 13, a coiler 14, and a controller 100. A steel plate to be hot-rolled by the rolling system 20 is conveyed in a longitudinal direction of the steel plate (a lateral direction in FIG. 1). A plate-width direction is a direction perpendicular to both the longitudinal direction and a plate-thickness direction of the steel plate. A plate width of the steel plate is, for example, around 900 mm to 2000 mm. A plate thickness of the steel plate (slab) prior to rolling is, for example, around 200 mm to 250 mm. The plate thickness of the steel plate after exiting the finishing mill 10 is, for example, around 1 mm to 25 mm.

The slab heating furnace 1 heats the steel plate (slab) prior to rolling to, for example, around 1200° C. The high-pressure descaling apparatus 2 removes scales from a surface of the steel plate having exited the slab heating furnace 1 by jetting high-pressure water onto the steel plate from above and below. The edger 3 performs rolling of the steel plate in the plate-width direction. The roughing mill 4 performs rough rolling of the steel plate in the plate-thickness direction. The first thermometer 5 measures the temperature of the steel plate having rolled by the roughing mill 4. The second thermometer 6 measures the temperature of the steel plate prior to heating by the edge heater 7.

The edge heater 7 heats an edge part extending in the longitudinal direction of the steel plate by induction heating. The edge heater 7 includes induction heating coils which form a pair so as to sandwich a pass line of the steel plate from above and below. Using a magnetic field generated by passing a high-frequency current through the induction heating coils, the edge heater 7 generates an eddy current in the edge part of the steel plate and heats only the edge part of the steel plate with Joule heat created by the eddy current.

When a surface temperature of the steel plate temporarily drops due to water cooling during descaling, roll heat conduction, or the like, the surface temperature may subsequently rise due to a recuperating effect produced by thermal conduction from inside the steel plate. The plate width of the steel plate is overwhelmingly longer than the plate thickness thereof. Thus, compared to recuperation in the plate-thickness direction, recuperation in the plate-width direction requires a longer period of time. As a result, a temperature of the edge part of the steel plate tends to be lower than a temperature of a central part in a plate-width direction. When there is a large difference between the temperature of the edge part and the temperature of the central part in the plate-width direction, quality in the width direction becomes uneven. The temperature of the edge part can be prevented from dropping by heating only the edge part of the steel plate with the edge heater 7.

The crop shear 8 shears a head end part and a tail end part of the steel plate. The finishing-entry-side descaling apparatus 9 removes scales from the surface of the steel plate on an entry side of the finishing mill 10. The finishing mill 10 finish-rolls the steel plate to a prescribed thickness. The third thermometer 11 measures the temperature of the steel plate having finish-rolled by the finishing mill 10. The runout laminar spray cooling apparatus 12 cools the steel plate. The fourth thermometer 13 measures the temperature of the steel plate having been cooled by the runout laminar spray cooling apparatus 12. The coiler 14 takes up the steel plate.

The first thermometer 5, the second thermometer 6, the third thermometer 11, and the fourth thermometer 13 are radiation thermometers. The first thermometer 5, the second thermometer 6, the third thermometer 11, and the fourth thermometer 13 measure temperature of a surface (top surface) of the steel plate.

The controller 100 is connected to the respective equipment described above which are provided in the rolling system 20. In terms of functions thereof, the controller 100 includes an element dividing unit 100*a*, a temperature calculating unit 100*b*, and an edge heater control unit 100*c*. The element dividing unit 100*a* executes a step of dividing a cross section perpendicular to a longitudinal direction of a steel plate to be hot-rolled by the rolling system 20 into a plurality of rectangular elements for temperature calculation. The temperature calculating unit 100*b* executes a step of calculating, using a finite difference method, a temperature of each of the rectangular elements divided by the element dividing unit 100*a*. The temperature calculating unit 100*b* calculates a predicted temperature, an estimated temperature, or the like of each rectangular element. The edge heater control unit 100*c* executes a step of controlling power of the edge heater 7 or an amount of applied heat by the edge heater 7 based on a calculation result of the temperature calculating unit 100*b*. Furthermore, the controller 100 may calculate or control various amounts (a rolling force, a rolling torque, an amount of cooling water, and the like) of the rolling process using a calculation result of the temperature calculating unit 100*b*.

Figure 2:
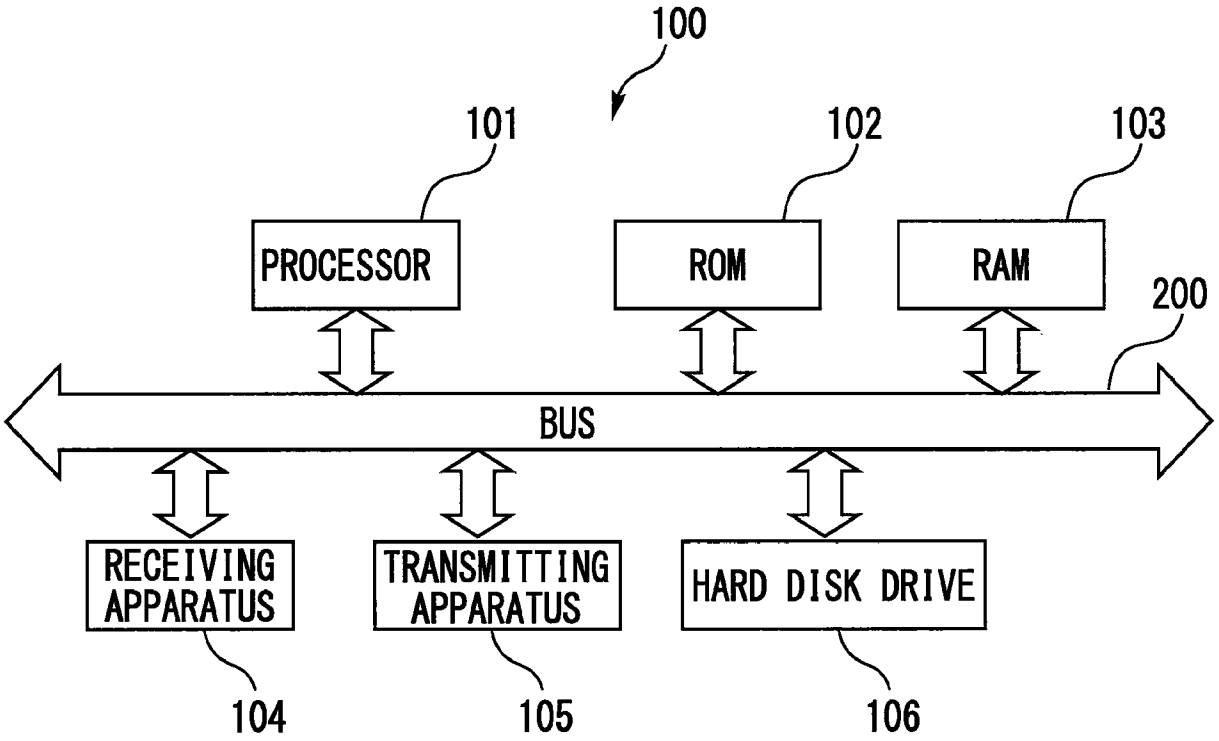
FIG. 2 is a hardware configuration diagram of a controller included in the rolling system shown in FIG. 1.

Next, an example of a hardware configuration of the controller 100 will be described with reference to FIG. 2. FIG. 2 is a hardware configuration diagram of the controller 100 included in the rolling system 20 shown in FIG. 1. As shown in FIG. 2, the controller 100 according to the present first embodiment includes a processor 101, a ROM (read only memory) 102, a RAM (random access memory) 103, a receiving apparatus 104, a transmitting apparatus 105, a hard disk drive 106, and a bus 200. The processor 101, the ROM 102, the RAM 103, the receiving apparatus 104, the transmitting apparatus 105, and the hard disk drive 106 are mutually connected via the bus 200.

The ROM 102, the RAM 103, and the hard disk drive 106 are storage devices. The ROM 102 is constituted by a nonvolatile semiconductor or the like and stores programs such as an operation system to be executed by the processor 101. The RAM 103 is constituted by a volatile semiconductor or the like and temporarily stores programs, data, and the like required by the processor 101 for executing various types of processing. The hard disk drive 106 stores programs to be executed by the processor 101.

The receiving apparatus 104 receives temperature information measured by the first thermometer 5, the second thermometer 6, the third thermometer 11, and the fourth thermometer 13 of the rolling system 20. In addition, the receiving apparatus 104 receives process values and the like detected by other sensors or the like (not illustrated) included in the rolling system 20. The transmitting apparatus 105 transmits various control signals generated by the processor 101 to respective equipment including the high-pressure descaling apparatus 2, the edger 3, the roughing mill 4, the edge heater 7, the crop shear 8, the finishing-entry-side descaling apparatus 9, the finishing mill 10, the runout laminar spray cooling apparatus 12, and the coiler 14.

Functions and operations of the element dividing unit 100*a*, the temperature calculating unit 100*b*, the edge heater control unit 100*c*, and the like of the controller 100 are achieved by the processor 101 by executing programs stored in a storage device. Alternatively, a configuration may be adopted in which functions and operations of the controller 100 are achieved by cooperation of a plurality of pairs of processors and storage devices.

Figure 3:
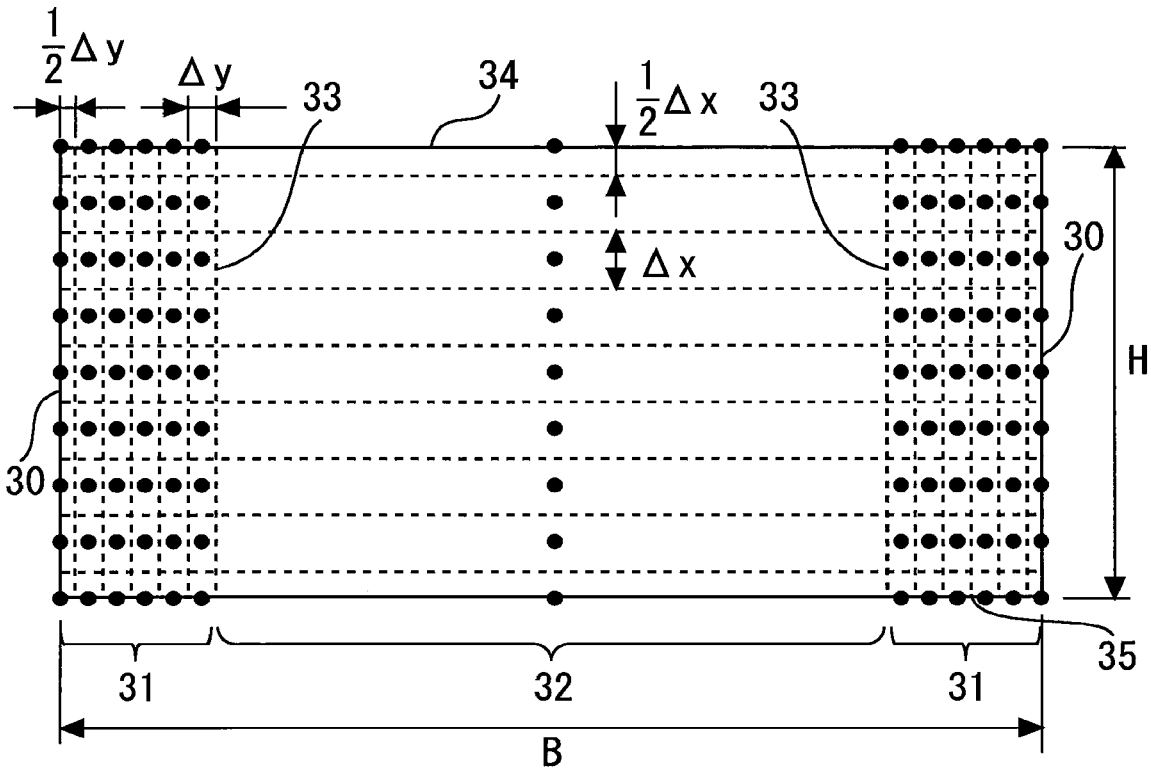
FIG. 3 is a diagram showing a state where a cross section perpendicular to a longitudinal direction of a steel plate is divided into a plurality of rectangular elements.

Next, a method by which the element dividing unit 100*a* divides a cross section perpendicular to the longitudinal direction of the steel plate into a plurality of rectangular elements used in temperature calculation will be described. FIG. 3 is a diagram showing a state where a cross section perpendicular to the longitudinal direction of the steel plate is divided into a plurality of rectangular elements. B denotes a plate width of the steel plate. H denotes a plate thickness of the steel plate. A dashed line in FIG. 3 indicates a boundary between rectangular elements. A side surface 30 of the steel plate is a side surface extending in the longitudinal direction of the steel plate.

As shown in FIG. 3, the element dividing unit 100*a* divides a cross section perpendicular to the longitudinal direction of the steel plate into a first region 31 and a second region 32. The first region 31 is a region including an edge part of the cross section. The first region 31 is a region including the side surface 30 of the steel plate. The second region 32 is a region including a center of the cross section in the plate-width direction. The second region 32 is a region wider than the first region 31. The second region 32 is an entire region of the cross section excluding the first region 31. A region boundary 33 constitutes a boundary between the first region 31 and the second region 32. The region boundary 33 is parallel to the side surface 30 of the steel plate. A length of the first region 31 in the plate-width direction or, in other words, a distance between the side surface 30 of the steel plate to the region boundary 33 is smaller than a length of the second region 32 in the plate-width direction.

The element dividing unit 100*a* divides the first region 31 such that a plurality of rectangular elements line up in the plate-thickness direction in the first region 31. The element dividing unit 100*a* divides the first region 31 such that a plurality of rectangular elements line up in the plate-width direction in the first region 31. In other words, the element dividing unit 100*a* respectively divides the first region 31 in the plate-thickness direction and the plate-width direction.

The element dividing unit 100*a* divides the second region 32 such that a plurality of rectangular elements line up in the plate-thickness direction in the second region 32. The element dividing unit 100*a* does not divide the second region 32 in the plate-width direction. In other words, the element dividing unit 100*a* only divides the second region 32 in the plate-thickness direction and does not divide the second region 32 in the plate-width direction. A length of each rectangular element in the second region 32 in the plate-width direction is equal to a length of the second region 32 itself in the plate-width direction. The length of each rectangular element in the second region 32 in the plate-width direction is overwhelmingly longer than a length of each rectangular element in the second region 32 in the plate-thickness direction. In other words, each rectangular element in the second region 32 is elongated.

Dividing a cross section perpendicular to the longitudinal direction of the steel plate as described above enables a two-dimensional temperature distribution of the cross section to be accurately calculated. The number of divisions of the first region 31 in the plate-thickness direction is desirably equal to the number of divisions of the second region 32 in the plate-thickness direction.

NT denotes the number of rectangular elements lined up in the plate-thickness direction from a center part in the plate-thickness direction to a top surface 34 or a bottom surface 35 of the steel plate. While NT=5 in the example shown in FIG. 3, a value of NT is not limited thereto. The number of rectangular elements lined up in the plate-thickness direction from the top surface 34 to the bottom surface 35 of the steel plate is expressed by 2NT−1. Ax denotes a length in the plate-thickness direction of each of rectangular elements excluding a rectangular element including the top surface 34 of the steel plate and a rectangular element including the bottom surface 35 of the steel plate. A length in the plate-thickness direction of the rectangular element including the top surface 34 of the steel plate is $\Delta x/2$. A length in the plate-thickness direction of the rectangular element including the bottom surface 35 of the steel plate is $\Delta x/2$.

In the present embodiment, the rectangular elements excluding rectangular elements including the top surface 34 or the bottom surface 35 of the steel plate are made uniform with a same length in the plate-thickness direction of $\Delta x$. The method is not limited to this and the rectangular elements excluding the rectangular elements including the top surface 34 or the bottom surface 35 of the steel plate may also have varied lengths in the plate-thickness direction. For example, lengths of the rectangular elements in the plate-thickness direction may become shorter from the center part in the plate-thickness direction toward the top surface 34 or the bottom surface 35 of the steel plate.

In a hot rolling process, as the temperature of the edge part of the steel plate drops, a steep temperature gradient in the plate-width direction may locally occur. The first region 31 is set so as to contain a portion in which such a steep temperature gradient in the plate-width direction occurs. It is considered that a temperature gradient in the plate-width direction hardly occurs in the second region 32. Thus, a temperature distribution of the steel plate can be accurately calculated without having to divide the second region 32 in the plate-width direction. In the present embodiment, by dividing only the first region 31 also in the plate-width direction and not dividing the second region 32 in the plate-width direction, the number of rectangular elements as a whole can be reduced. As a result, a temperature distribution of a steel plate in a hot rolling process can be accurately calculated including an edge part of the steel plate while reducing an increase in calculation load.

NW denotes the number of rectangular elements lined up in the plate-width direction in the first region 31. While NW=6 in the example shown in FIG. 3, a value of NW is not limited thereto. The number of rectangular elements in the second region 32 in the plate-width direction is 1. The first region 31 including one side surface 30 of the steel plate and the first region 31 including an opposite-side side surface 30 of the steel plate are symmetrically divided. Thus, the number of rectangular elements lined up in the plate-width direction from one side surface 30 to the other side surface 30 of the steel plate is expressed by 2NW+1.

Δy denotes a length in the plate-width direction of each of rectangular elements in the first region 31 excluding the rectangular elements including the side surfaces 30. A length in the plate-width direction of the rectangular elements including the side surfaces 30 is Δy/2. The length of one first region 31 in the plate-width direction is expressed by (NW−1)×Δy+Δy/2. The length of the second region 32 in the plate-width direction is a length obtained by subtracting the first region 31 at the two locations from a plate width B of the steel plate. Thus, the length of the second region 32 in the plate-width direction is expressed by B−(2NW−1)×Δy.

The temperature calculating unit 100*b* calculates a representative temperature of each rectangular element. The representative temperatures of the respective rectangular elements are temperatures at positions indicated by black dots in FIG. 3. A representative temperature of each rectangular element excluding the rectangular elements which include the surface (the top surface 34, the bottom surface 35, and the side surfaces 30) of the steel plate or, in other words, each rectangular element inside the steel plate is a temperature at a center position of the rectangular element. A representative temperature of each rectangular element including the surface (the top surface 34, the bottom surface 35, and the side surfaces 30) of the steel plate is a temperature of the surface.

In the example shown in FIG. 3, lengths of the rectangular elements in the first region 31 in the plate-width direction excluding the rectangular elements including the side surfaces 30 of the steel plate are all equal (Δy).

The plate width B of the steel plate is, for example, around 900 mm to 2000 mm. The length of the first region 31 in the plate-width direction or, in other words, a distance between the side surface 30 of the steel plate to the region boundary 33 is, for example, desirably around 100 mm to 150 mm. The length of the second region 32 in the plate-width direction is desirably greater than a sum of lengths in the plate-width direction of the first regions 31 on both sides. An increase in calculation load can be more reliably prevented by increasing the length of the second region 32 in the plate-width direction.

The first region 31 is desirably set so as to contain a region to be heated by the edge heater 7. In other words, the length of the first region 31 in the plate-width direction is desirably equal to or greater than a length in the plate-width direction of a portion to be heated by the edge heater 7. Accordingly, a temperature gradient in the plate-width direction of the steel plate after being heated by the edge heater 7 can be calculated more accurately.

Figure 4:
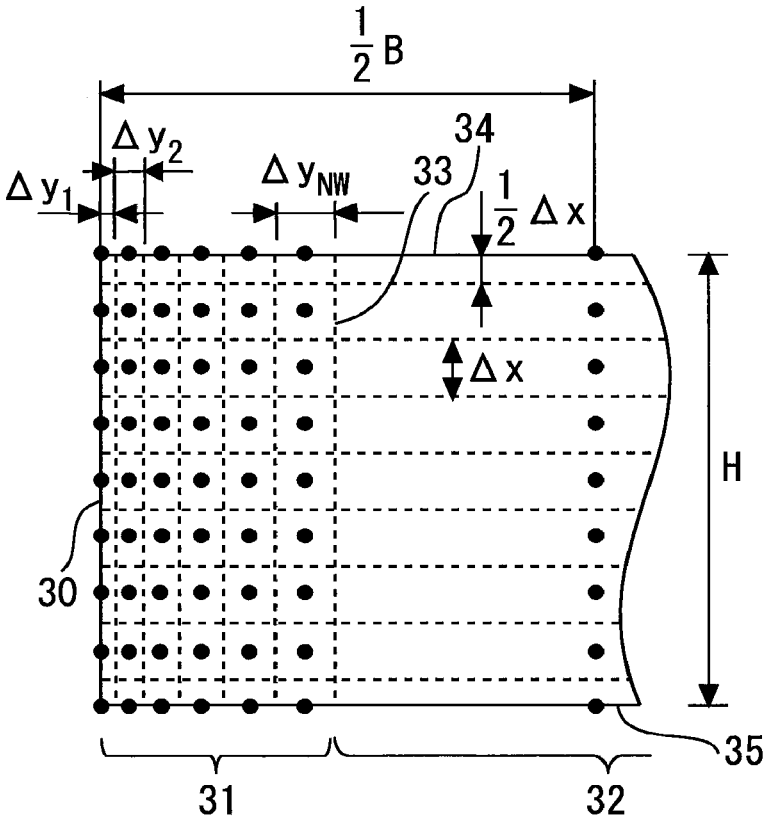
FIG. 4 is a diagram showing another example of a state where a cross section perpendicular to a longitudinal direction of a steel plate is divided into a plurality of rectangular elements.

FIG. 4 is a diagram showing another example of a state where a cross section perpendicular to the longitudinal direction of the steel plate is divided into a plurality of rectangular elements. Hereinafter, only differences of the example shown in FIG. 4 from the example shown in FIG. 3 described above will be described. In the example shown in FIG. 4, the length in the plate-width direction of rectangular elements in the first region 31 gradually decrease from a position near the region boundary 33 toward the side surface 30 of the steel plate. A temperature gradient of the first region 31 is relatively small in a portion near the second region 32 and relatively large in a portion near the side surface 30. Thus, by dividing the first region 31 as shown in FIG. 4, the temperature gradient of the first region 31 in the plate-width direction can be calculated more accurately while reducing the number of rectangular elements.

Lengths of the respective rectangular elements in the first region 31 in the plate-width direction are sequentially denoted, from the side surface 30 toward the region boundary 33, as $\Delta y_1$, $\Delta y_2$, $\Delta y_3$, $\Delta y_{NW}$. In the example shown in FIG. 4, $\Delta y_1<\Delta y_2<\Delta y_3<<\Delta y_{NW}$. By differentiating the length of each rectangular element in the first region 31 in the plate-width direction, the temperature gradient of the first region 31 in the plate-width direction can be calculated more accurately while reducing the number of rectangular elements. In addition to such a configuration, the lengths of the rectangular elements in the first region 31 in the plate-width direction may be differentiated every two, every three, or every several rectangular elements.

$\Delta y_{NW+1}$ denotes a length of each rectangular region in the second region 32 in the plate-width direction. $\Delta y_{NW-1}$ is equal to the length of the second region 32 itself in the plate-width direction. In the example shown in FIG. 4, $\Delta y_{NW+1}$ can be calculated by the following equation.

$$\Delta y_{NW+1}=B-2\times(\Delta y_1+\Delta y_2+\Delta y_3+\ldots+\Delta y_{NW})$$

Conceivable boundary conditions of the top surface 34 and the bottom surface 35 and boundary conditions of the left and right side surfaces 30 of the steel plate in the rolling system 20 are as follows. As boundary conditions of the top surface 34 and the bottom surface 35, contact heat conduction with a conveying roller is only conceivable for the bottom surface 35. In addition, during water spraying, water can be jetted so that the flow rate for the top surface 34 is different from the flow rate for the bottom surface 35. In this manner, the boundary condition of the top surface 34 may conceivably differ from the boundary condition of the bottom surface 35. In contrast, normally, it is conceivable that there is no difference in equipment or environment between the left and right side surfaces 30 of the steel plate. In other words, boundary conditions of the left and right side surfaces 30 of the steel plate can be considered approximately equal to each other. As a result, a temperature distribution of the first region 31 including the left-side side surface 30 and a temperature distribution of the first region 31 including the right-side side surface 30 can be considered approximately equal to each other. Thus, as a calculation using a finite difference method with respect to the first region 31, the controller 100 according to the present embodiment only calculates one of the first region 31 including the left-side side surface 30 and the first region 31 including the right-side side surface 30 and omits the calculation of the other one of the first regions 31. Accordingly, a calculation load of the finite difference method can be more or less halved.

Hereinafter, a method of calculating a temperature (representative temperature) of each rectangular element using the finite difference method according to the present embodiment will be described. A method of calculating temperatures of rectangular elements in the example shown in FIG. 4 will now be described. Moreover, a temperature of rectangular elements shown in FIG. 3 may be calculated using $2\times\Delta y_1=\Delta y_2=\Delta y_3=\ldots=\Delta y_{NW}$.

First, a volume of each rectangular element is calculated. In the following description, the respective rectangular elements will be distinguished from one another using i and j as indices. The index i represents a sequence of a rectangular element in the plate-thickness direction. A sequence of i=1, 2, 3, . . . , 2NT−1 is assumed from the top surface 34 toward the bottom surface 35 of the steel plate. The index j represents a sequence of a rectangular element in the plate-width direction. A sequence of j=1, 2, 3, . . . , NW, NW+1 is assumed from the side surface 30 toward the center of the steel plate. j=1 to NW correspond to rectangular elements in the first region 31. j=NW+1 corresponds to a rectangular element in the second region 32. A rectangular element that is i-th from top and j-th from the side surface 30 will be referred to as an i_j-th element (refer to FIG. 5). $V_{i,j}$ [mm$^2$] denotes a volume of the i_j-th element. It is assumed that each rectangular element has a unit length in the longitudinal direction of the steel plate. In order to simply calculations, $V_{i,j}$ is assumed to indicate a value obtained by dividing a volume of each rectangular element by the unit length in the longitudinal direction of the steel plate. Thus, $V_{i,j}$ is in area units. In addition, in calculations of a heat balance of each rectangular element to be described later, a value obtained by dividing an amount of heat by the unit length in the longitudinal direction of the steel plate will be similarly used in order to simply calculations.

A 1_j-th element is a rectangular element including the top surface 34 of the steel plate. A volume $V_{i,j}$ of the 1_j-th element can be calculated by the following equation.

$$V_{i,j}=\tfrac{1}{2}\Delta x\cdot\Delta y_j \qquad \text{[Math. 1]}$$

The i_j-th element (i=1, 2, 3, . . . , 2NT−2) is a rectangular element which does not include the top surface 34 and the bottom surface 35 of the steel plate. The volume $V_{i,j}$ of the i_j-th element (i=1, 2, 3, . . . , 2NT−2) can be calculated by the following equation.

$$V_{i,j}=\Delta x\cdot\Delta y_j \qquad \text{[Math. 2]}$$

A (2NT−1)_j-th element is a rectangular element including the bottom surface 35 of the steel plate. A volume $V_{2NT-1j}$ of the (2NT−1)_j-th element can be calculated by the following equation.

$$V_{2NT-1,j}=\tfrac{1}{2}\Delta x\cdot\Delta y_j \qquad \text{[Math. 3]}$$

Figure 5:
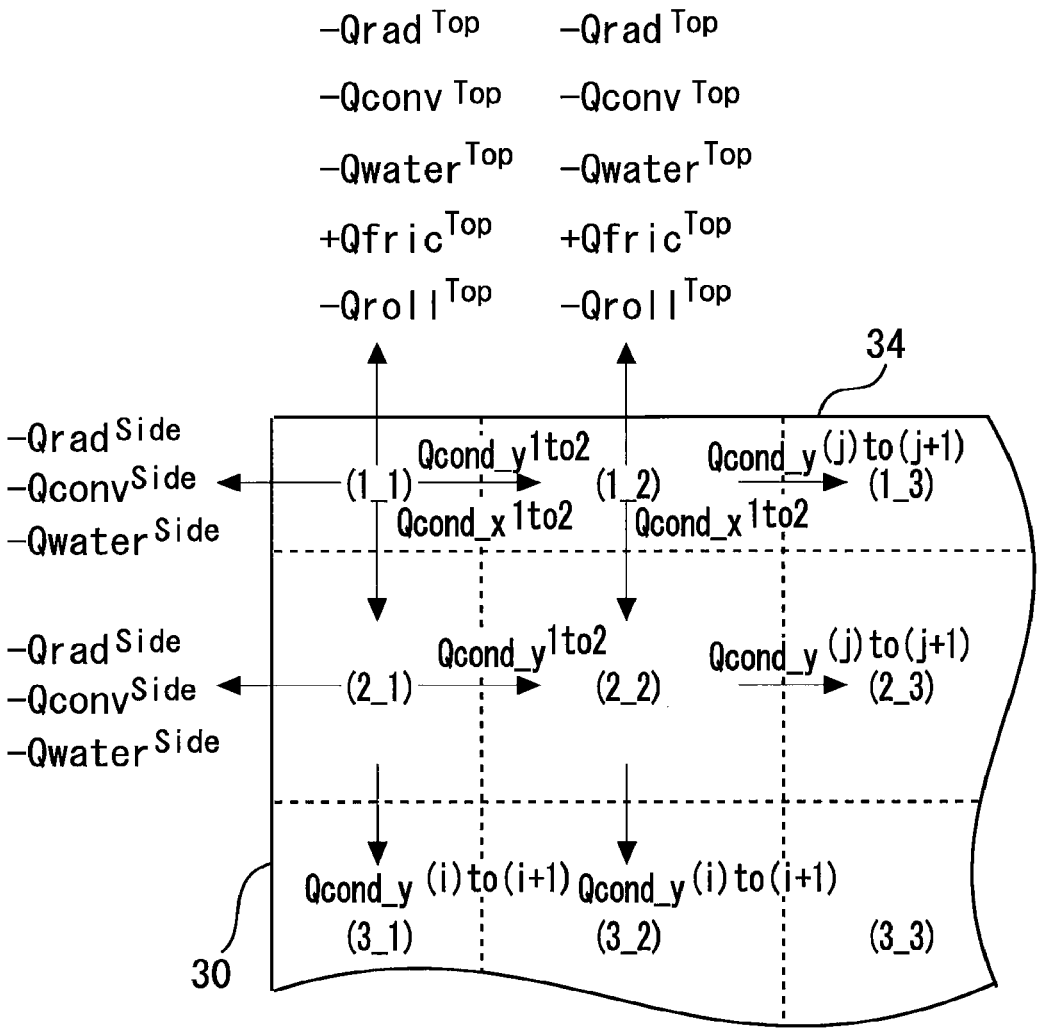
FIG. 5 is a diagram schematically showing a heat balance of a rectangular element.

As a steel plate in a hot rolling process is conveyed on a line such as that shown in FIG. 1, the steel plate is subjected to various types of positive and negative heat including thermal radiation, cooling by air and water (heat transfer), heat generated by processing, and heat conduction with a roll of a rolling mill. Δt denotes a time increment of calculations using the finite difference method. The temperature calculating unit 100*b* calculates, for each rectangular element, a heat balance during a period represented by the time increment Δt. FIG. 5 is a diagram schematically showing a heat balance of a rectangular element. Various amounts of heat in the heat balance of a rectangular element can be calculated using theoretical expressions used in typical heat transfer and rolling theories. First, a method of calculating a heat balance of a rectangular element including the top surface 34 or the bottom surface 35 but not including the side surface 30 of the steel plate will be described.

The 1_j-th element (j=2, 3, . . . , NW+1) is a rectangular element which includes the top surface 34 but does not include the side surface 30 of the steel plate. The heat balance of the 1_j-th element (j=2, 3, . . . , NW+1) can be expressed as the following equation.

$$\Delta Q_{1,j}=-Q_{rad}^{Top}-Q_{water}^{Top}-Q_{conv}^{Top}+Q_{fric}^{Top}-Q_{roll}^{Top}+Q_{def}+Q_{EH}-Q_{con_x}^{1to2}+Q_{cond_y}^{(j-1)to(j)}-Q_{cond_y}^{(j)to(j+1)} \qquad \text{[Math. 4]}$$

The (2NT−1)_j-th element (j=2, 3, . . . , NW+1) is a rectangular element which includes the bottom surface 35 but does not include the side surface 30 of the steel plate. The heat balance of the (2NT−1)_j-th element (j=2, 3, . . . , NW+1) can be expressed as the following equation.

$$\Delta Q_{2NT-1,j}=-Q_{rad}^{Bot}-Q_{water}^{Bot}-Q_{conv}^{Bot}+Q_{fric}^{Bot}-Q_{roll}^{Bot}+Q_{def}+Q_{EH}-Q_{con_x}^{(2NT-2)to(2NT-1)}+Q_{cond_y}^{(j-1)to(j)}-Q_{cond_y}^{(j)to(j+1)} \qquad \text{[Math. 5]}$$

where $\Delta Q_{1,j}$ [W/mm]: heat balance of 1_j-th element (j=2, 3, . . . , NW+1), $\Delta Q_{2NT-1,j}$ [W/mm]: heat balance of (2NT−1)_j-th element (j=2, 3, . . . , NW+1), $Q_{rad}^{Top}$ [W/mm]: amount of thermal radiation from top surface 34 of steel plate, $Q_{rad}^{Bot}$ [W/mm]: amount of thermal radiation from bottom surface 35 of steel plate, $Q_{water}^{Top}$ [W/mm]: amount of outflow heat due to water cooling from top surface 34 of steel plate, $Q_{water}^{Bot}$ [W/mm]: amount of outflow heat due to water cooling from bottom surface 35 of steel plate, $Q_{conv}^{Top}$ [W/mm]: amount of outflow heat due to air cooling from top surface 34 of steel plate, $Q_{conv}^{Bot}$ [W/mm]: amount of outflow heat due to air cooling from bottom surface 35 of steel plate, $Q_{fric}^{Top}$ [W/mm]: amount of frictional heat flowing into top surface 34 of steel plate in rolling roll bite, $Q_{fric}^{Bot}$ [W/mm]: amount of frictional heat flowing into bottom surface 35 of steel plate in rolling roll bite, $Q_{roll}^{Top}$ [W/mm]: amount of thermal conduction to roll from top surface 34 of steel plate in rolling roll bite, $Q_{roll}^{Bot}$ [W/mm]: amount of thermal conduction to roll from bottom surface 35 of steel plate in rolling roll bite, $Q_{def}$ [W/mm]: amount of heat generated by processing of steel plate in rolling roll bite, $Q_{EH}$ [W/mm]: amount of heat applied by edge heater 7, $Q_{cond_x}^{1to2}$ [W/mm]: amount of thermal conduction in plate-thickness direction (x direction) from 1_j-th element to 2_j-th element, $Q_{cond_x}^{(2NT-2)to(2NT-1)}$ [W/mm]: amount of thermal conduction in plate-thickness direction (x direction) from (2NT−2)_j-th element to (2NT−1)_j-th element, $Q_{cond_y}^{(j-1)to(j)}$ [W/mm]: amount of thermal conduction in plate-width direction (y direction) from i_(j−1)-th element to i_j-th element, and $Q_{cond_y}^{(j)to(j+1)}$ [W/mm]: amount of thermal conduction in plate-width direction (y direction) from i_j-th element to i_(j+1)-th element.

Amounts of thermal radiation $Q_{rad}^{Top}$ and $Q_{rad}^{Bot}$ from the top surface 34 and the bottom surface 35 of the steel plate can be calculated based on temperatures of the top surface 34 and the bottom surface 35. The amount of thermal radiation $Q_{rad}^{Top}$ or $Q_{rad}^{Bot}$ from the top surface 34 or the bottom surface 35 of each rectangular element can be calculated by multiplying a heat flux of thermal radiation of the top surface 34 or the bottom surface 35 by a length of the rectangular element in the plate-width direction.

Amounts of outflow heat $Q_{water}^{Top}$ and $Q_{water}^{Bot}$ due to water cooling from the top surface 34 and the bottom surface 35 of the steel plate can be calculated based on temperatures of the top surface 34 and the bottom surface 35, a water temperature, and a heat transfer coefficient. The amount of outflow heat $Q_{water}^{Top}$ or $Q_{water}^{Bot}$ due to water cooling from the top surface 34 or the bottom surface 35 of each rectangular element can be calculated by multiplying a heat flux due to water cooling of the top surface 34 or the bottom surface 35 by the length of the rectangular element in the plate-width direction. The amounts of outflow heat $Q_{water}^{Top}$ and $Q_{water}^{Bot}$ due to water cooling from the top surface 34 and the bottom surface 35 of the steel plate are only calculated in a water-cooled region. The water-cooled region is a region in which the steel plate is cooled by water. In the present embodiment, the water-cooled region includes the high-pressure descaling apparatus 2, the finishing-entry-side descaling apparatus 9, and the runout laminar spray cooling apparatus 12. The finishing mill 10 shown in FIG. 1 includes a plurality of stands. In some cases, a water spray apparatus is provided between the stands of the finishing mill 10. The water-cooled region includes all regions in which the steel plate is cooled by water including such a water spray apparatus.

Amounts of outflow heat $Q_{conv}^{Top}$ and $Q_{conv}^{Bot}$ due to air cooling from the top surface 34 and the bottom surface 35 of the steel plate can be calculated based on temperatures of the top surface 34 and the bottom surface 35, an air temperature, and a heat transfer coefficient. The amount of outflow heat $Q_{conv}^{Top}$ or $Q_{conv}^{Bot}$ due to air cooling from the top surface 34 or the bottom surface 35 of each rectangular element can be calculated by multiplying a heat flux due to air cooling of the top surface 34 or the bottom surface 35 by the length of the rectangular element in the plate-width direction. The amounts of outflow heat $Q_{conv}^{Top}$ and $Q_{conv}^{Bot}$ due to air cooling from the top surface 34 and the bottom surface 35 of the steel plate are only calculated in an air-cooled region. The air-cooled region is a region in which the top surface 34 and the bottom surface 35 of the steel plate are cooled by coming into contact with air.

Amounts of heat $Q_{fric}^{Top}$, $Q_{fric}^{Bot}$, $Q_{roll}^{Top}$, $Q_{roll}^{Bot}$, and $Q_{def}$ in a rolling roll bite are only calculated inside roll bites of the roughing mill 4 and the finishing mill 10. Amounts of frictional heat $Q_{fric}^{Top}$ and $Q_{fric}^{Bot}$ in the rolling roll bite can be calculated using a plate speed, an amount of rolling reduction, a coefficient of friction, and the like. The amount of frictional heat $Q_{fric}^{Top}$ or $Q_{fric}^{Bot}$ of the top surface 34 or the bottom surface 35 of each rectangular element can be calculated by multiplying a heat flux of frictional heat of the top surface 34 or the bottom surface 35 in the roll bite by a length of the rectangular element in the plate-width direction.

Amounts of thermal conduction $Q_{roll}^{Top}$ and $Q_{roll}^{Bot}$ to a roll in the rolling roll bite can be calculated using temperatures, thermal conductivity, and the like of the top surface 34, the bottom surface 35, and the roll. The amount of thermal conduction $Q_{roll}^{Top}$ or $Q_{roll}^{Bot}$ to the roll from the top surface 34 or the bottom surface 35 of each rectangular element can be calculated by multiplying a heat flux of thermal conduction to the roll from the top surface 34 or the bottom surface 35 in the roll bite by a length of the rectangular element in the plate-width direction.

An amount of heat generated by processing $Q_{def}$ in the rolling roll bite can be calculated using an amount of rolling reduction, material deformation resistance, and the like. The amount of heat generated by processing $Q_{def}$ in the rolling roll bite can be calculated by distributing a total amount of generated heat to each rectangular element at a ratio of the volume $V_{i,j}$ of each rectangular element.

An amount of applied heat $Q_{EH}$ by the edge heater 7 is only calculated inside the edge heater 7. The amount of applied heat $Q_{EH}$ by the edge heater 7 is only included with respect to a part of the rectangular elements in the first region 31. In the present embodiment, the amount of applied heat $Q_{EH}$ by the edge heater 7 is only included with respect to rectangular elements of which a distance from the side surface 30 of the steel plate is equal to or less than a prescribed distance. In other words, $j_{EH}$ satisfying $j_{EH}<NW$ is determined in advance and the amount of applied heat $Q_{EH}$ by the edge heater 7 is only included with respect to an i_j-th element (j=1, 2, 3, . . . , $j_{EH}$). $j_{EH}$ can be determined based on a region to be heated by the edge heater 7 (a length in the plate-width direction of a portion to be heated by the edge heater 7). The amount of applied heat $Q_{EH}$ by the edge heater 7 can be calculated by distributing the total amount of generated heat to a group of rectangular elements set as objects at a ratio of the volume $V_{i,j}$ of each rectangular element.

An amount of thermal conduction between rectangular elements can be calculated based on temperatures of both rectangular elements and thermal conductivity. An amount of thermal conduction between rectangular elements in the plate-thickness direction (x direction) can be calculated by multiplying a heat flux of thermal conduction by a length of the rectangular elements in the plate-width direction. An amount of thermal conduction between rectangular elements in the plate-width direction (y direction) can be calculated by multiplying a heat flux of thermal conduction by a length of the rectangular elements in the plate-thickness direction.

Moreover, when calculating the heat balance of a rectangular element including the bottom surface 35 of the steel plate, an amount of thermal conduction from the bottom surface 35 of the steel plate to a conveying roller may be further included.

Next, a method of calculating a heat balance of a rectangular element including the side surface 30 but not including the top surface 34 and the bottom surface 35 of the steel plate will be described. The i_1-th element (i=1, 2, 3, . . . , 2N−2) is a rectangular element which includes the side surface 30 but does not include the top surface 34 and the bottom surface 35 of the steel plate. While a heat balance of the i_1-th element (i=2, 3, . . . , 2N−2) will be described below, only a difference from the heat balance described earlier will be explained. The heat balance of the i_1-th element (i=2, 3, . . . , 2N−2) can be expressed as the following equation.

$$\Delta Q_{i,1}=-Q_{rad}^{Side}-Q_{water}^{Side}-Q_{conv}^{Side}+Q_{def}+Q_{EH}+Q_{con_x}^{(i-1)to(i)}-Q_{cond_x}^{(i)to(i+1)}-Q_{cond_y}^{1to2} \quad \text{[Math. 6]}$$

where $\Delta Q_{i,1}$ [W/mm]: heat balance of i_1-th element (i=2, 3, . . . , 2N−2), $Q_{rad}^{Side}$ [W/mm]: amount of thermal radiation from side surface 30 of steel plate, $Q_{water}^{Side}$ [W/mm]: amount of outflow heat due to water cooling from side surface 30 of steel plate, $Q_{conv}^{Side}$ [W/mm]: amount of outflow heat due to air cooling from side surface 30 of steel plate, $Q_{cond_x}^{(i-1)to(i)}$ [W/mm]: amount of thermal conduction in plate-thickness direction (x direction) from (i−1)_1-th element to i_1-th element, $Q_{cond_x}^{(i)to(i+1)}$ [W/mm]: amount of thermal conduction in plate-thickness direction (x direction) from i_1-th element to (i+1)_1-th element, and $Q_{cond_y}^{1to2}$ [W/mm]: amount of thermal conduction in plate-width direction (y direction) from i_1-th element to i_2-th element.

An amount of thermal radiation $Q_{rad}^{Side}$ from the side surface 30 of the steel plate can be calculated based on a temperature of the side surface 30. The amount of thermal radiation $Q_{rad}^{Side}$ from the side surface 30 of each rectangular element can be calculated by multiplying a heat flux of thermal radiation of the side surface 30 by a length of the rectangular element in the plate-thickness direction.

An amount of outflow heat $Q_{water}^{Side}$ due to water cooling from the side surface 30 of the steel plate can be calculated based on a temperature of the side surface 30, a water temperature, and a heat transfer coefficient. The amount of outflow heat $Q_{water}^{Side}$ due to water cooling from the side surface 30 of the steel plate is only calculated in the water-cooled region. The amount of outflow heat $Q_{water}^{Side}$ due to water cooling from the side surface 30 of each rectangular element can be calculated by multiplying a heat flux due to water cooling of the side surface 30 by the length of the rectangular element in the plate-thickness direction.

An amount of outflow heat $Q_{conv}^{Side}$ due to air cooling from the side surface 30 of the steel plate can be calculated based on a temperature of the side surface 30, an air temperature, and a heat transfer coefficient. The amount of outflow heat $Q_{conv}^{Side}$ due to air cooling from the side surface 30 of the steel plate is only calculated in the air-cooled region. The amount of outflow heat $Q_{conv}^{Side}$ due to air cooling from the side surface 30 of each rectangular element can be calculated by multiplying a heat flux due to air cooling of the side surface 30 by the length of the rectangular element in the plate-thickness direction.

In the water-cooled region, water is rarely directly applied to the side surface 30 of the steel plate. Most of water cooling for the side surface 30 is due to a part of water applied to the top surface 34 of the steel plate flowing to the side surface 30. Thus, the heat flux of water cooling from the side surface 30 is conceivably smaller than the heat flux of water cooling from the top surface 34. In consideration of these matters, the following calculations may be performed in the present embodiment.

If $q_{water}^{Side}$ [W/mm$^2$] denotes the heat flux of water cooling from the side surface 30, $q_{water}^{Top}$ [W/mm$^2$] notes the heat flux of water cooling from the top surface 34, and a prescribed adjustment coefficient larger than 0 and smaller than 1 is denoted by β, then $q_{water}^{Side}$ can be expressed by the following equation.

$$q_{water}^{Side}=\beta\times q_{water}^{Top}$$

A calculation load can be further reduced by calculating the amount of outflow heat $Q_{water}^{Side}$ due to water cooling of the side surface 30 using $q_{water}^{Side}$ calculated by the equation given above. Moreover, the calculation described above may be replaced with the following. If $h_{water}^{Side}$ denotes a heat transfer coefficient of water cooling for the side surface 30 and $h_{water}^{Top}$ denotes a heat transfer coefficient of water cooling for the top surface 34, then $h_{water}^{Side}$ can be expressed by the following equation.

$$h_{water}^{Side}=\beta\times h_{water}^{Top}$$

An effect similar to that described above can be obtained by calculating a heat flux of water cooling from the side surface 30 using $h_{water}^{Side}$ calculated by the equation given above and then calculating the amount of outflow heat $Q_{water}^{Side}$ due to water cooling of the side surface 30 using the heat flux.

Next, while a method of calculating a heat balance of a rectangular element including both the top surface 34 or the bottom surface 35 and the side surface 30 of the steel plate will be described, only differences from the heat balance described earlier will be explained. A 1_1-th element is a corner rectangular element including the top surface 34 and the side surface 30 of the steel plate. The heat balance of the 1_1-th element can be expressed as the following equation.

$$\Delta Q_{1,1}=-Q_{rad}^{Top}-Q_{rad}^{Side}-Q_{water}^{Top}-Q_{water}^{Side}-Q_{conv}^{Top}-Q_{conv}^{Side}+Q_{fric}^{Top}-Q_{roll}^{Top}+Q_{def}+Q_{EH}-Q_{cond_x}^{1to2}-Q_{cond_y}^{1to2} \quad \text{[Math. 7]}$$

A (2N−1)_1-th element is a corner rectangular element including the bottom surface 35 and the side surface 30 of the steel plate. The heat balance of the (2N−1)_1-th element can be expressed as the following equation.

$$\Delta Q_{(2NT-1),1}=-Q_{rad}^{Bot}-Q_{rad}^{Side}-Q_{water}^{Bot}-Q_{water}^{Side}-Q_{conv}^{Bot}-Q_{conv}^{Side}+Q_{fric}^{Bot}-Q_{roll}^{Bot}+Q_{def}+Q_{EH}-Q_{cond_x}^{(2NT-2)to(2NT-1)}-Q_{cond_y}^{1to2} \quad \text{[Math. 8]}$$

Moreover, when calculating the heat balance of a rectangular element including the side surface 30 of the steel plate, an amount of thermal conduction from the side surface 30 of the steel plate to an edger roll of the edger 3 may be further included.

Next, while a method of calculating a heat balance of an internal rectangular element including none of the top surface 34, the bottom surface 35, and the side surface 30 of the steel plate will be described, only differences from the heat balance described earlier will be explained. The i_j-th element (i=2, 3, . . . , 2NT−2) (j=2, 3, . . . , NW+1) is such an internal rectangular element. With these rectangular elements, all four sides are adjacent to other rectangular elements. The heat balance of the i_j-th element (i=2, 3, . . . , 2NT−2) (j=2, 3, . . . , NW+1) can be expressed as the following equation.

$$\Delta Q_{i,j}=Q_{cond_x}^{(i-1)to(i)}-Q_{cond_x}^{(i)to(i+1)}+Q_{cond_y}^{(j-1)to(j)}-Q_{cond_y}^{(j)to(j+1)}+Q_{def}+Q_{EH} \quad \text{[Math. 9]}$$

The temperature calculating unit 100*b* calculates an amount of temperature variation of each rectangular element between time increments Δt based on the volume $V_{i,j}$ and the heat balance $\Delta Q_{i,j}$ of each rectangular element described above.

$$\Delta T_{i,j}=\frac{\Delta Q_{i,j}}{\rho\cdot Cp_{i,j}\cdot V_{i,j}}\cdot\Delta t \quad \text{[Math. 10]}$$

where $\Delta T_{i,j}$ [K]: amount of temperature variation of i_j-th element during time interval Δt, ρ [kg/mm$^3$]: density of steel plate, and $Cp_{i,j}$ [J/kg/K]: specific heat of i_j-th element.

Subsequently, based on the amount of temperature variation $\Delta T_{i,j}$ of each rectangular element between time increments Δt described above, the temperature calculating unit

100*b* calculates a temperature of each rectangular element after the time increment Δt has elapsed according to the following equation.

$$T_{i,j}^{k+1}=T_{i,j}^{k}+\Delta T_{i,j}$$

where $T_{i,j}^{k}$ [K]: temperature of i_j-th element in time step k $T_{i,j}^{k+1}$ [K]: temperature of i_j-th element in time step (k+1) after the time increment Δt has elapsed.

Using the finite difference method, the temperature calculating unit 100*b* calculates a heat balance, an amount of temperature variation, and a temperature of each rectangular element for each time increment Δt as described above. Accordingly, the temperature calculating unit 100*b* can calculate the temperature of each rectangular element in each time step of each time increment Δt from start to calculation to end of calculation. By calculating the temperature of each rectangular element, a temperature distribution of a cross section perpendicular to the longitudinal direction of the steel plate is obtained.

When a cross-sectional shape of the steel plate changes due to rolling of the steel plate, the element dividing unit 100*a* divides a new cross section into a plurality of rectangular elements. When a cross section is re-divided, the volume $V_{i,j}$ of each rectangular element is re-calculated. The element dividing unit 100*a* may reduce the number of divisions in the plate-thickness direction as the plate thickness of the steel plate decreases.

A position at which the temperature calculating unit 100*b* starts calculation can be, for example, a position at which the steel plate (slab) exits the slab heating furnace 1. The slab heating furnace 1 is controlled so that the steel plate (slab) is heated to a prescribed temperature. The temperature calculating unit 100*b* may consider that the entire steel plate (slab) is heated to a uniform temperature when exiting the slab heating furnace 1 and adopt the prescribed temperature as an initial temperature of each rectangular element. In addition, when a temperature distribution of a steel plate currently being heated by the slab heating furnace 1 is numerically calculated, the temperature calculating unit 100*b* may set an initial temperature of each rectangular element based on a result of the calculation.

A position at which the temperature calculating unit 100*b* ends calculation can be, for example, a position of the fourth thermometer 13 before the coiler 14. The temperature calculating unit 100*b* may correct a calculation result based on a surface temperature of the steel plate measured by the first thermometer 5, the second thermometer 6, the third thermometer 11, or the fourth thermometer 13.

As described earlier, the temperature of an edge part of a steel plate in a hot rolling process tends to drop. In addition, when the steel plate is heated by the edge heater 7, the temperature rises only in the edge part of the steel plate. Thus, the edge part of the steel plate tends to have a large temperature variation and a large temperature gradient. According to the present embodiment, by dividing the first region 31 into a plurality of elements also in the plate-width direction, the temperature distribution of the edge part of the steel plate having a large temperature variation and a large temperature gradient can be accurately calculated. In the second region 32, the temperature is approximately uniform along the plate-width direction. Thus, the temperature distribution of the steel plate can be accurately calculated without having to divide the second region 32 in the plate-width direction. According to the present embodiment, an increase in the total number of rectangular elements can be reduced by not dividing the second region 32 in the plate-width direction and dividing the second region 32 only in the plate-thickness direction. As a result, an increase in a calculation load can be prevented. According to the present embodiment, a load on a computer can be sufficiently reduced even in an online control calculation of an actual operation.

Moreover, in the present invention, with respect to the time increment Δt in calculations using to the finite difference method, a method of varying the time increment Δt in accordance with a change in boundary conditions in an air-cooled region, a water-cooled region, and a rolling region may be used so that an amount of temperature variation per time increment Δt becomes approximately the same. This method is disclosed in Japanese Patent No. 5391205. According to this method, the number of calculations can be reduced while securing accuracy of an amount of temperature variation for each time step and, consequently, a computer load when performing an online control calculation of an actual operation can be further reduced.

In a conveying process of a steel plate in the rolling system 20 shown in FIG. 1, a wide variety of heat transfer phenomena occurs including thermal radiation, air-cooling convection, water-cooling during descaling and laminar spraying, heat generated by processing during rolling, heat generated by friction, and roll heat conduction. The temperatures of surfaces (the top surface 34, the bottom surface 35, and the side surfaces 30) of the steel plate change from moment to moment. A change in a surface temperature of the steel plate creates a difference between the temperature of the surface and a temperature of an interior of the steel plate. Thermal conduction attributable to such a temperature difference also causes the internal temperature of the steel plate to change. In a state where plate thickness is large such as in the rough rolling stage, after the surface temperature temporarily drops due to water cooling during descaling, roll heat conduction, or the like, the surface temperature may subsequently rise due to a recuperating effect produced by thermal conduction from inside the steel plate. In this manner, due to changes in boundary conditions, the surface temperature of the steel plate does not drop uniformly and exhibits a variation in which the surface temperature repetitively drops and rises. Due to such various changes in boundary conditions as described above, the temperature variation of the surface of the steel plate is large. The temperature variation inside the steel plate is mainly caused by thermal conduction and is relatively gradual. As a result, a temperature distribution which changes in a complex manner is created inside a cross section perpendicular to the longitudinal direction of the steel plate. According to the present embodiment, by calculating the temperature of each rectangular element using a finite difference method, such a temperature distribution which changes in a complex manner can be accurately calculated.

The various values of a rolling process such as a rolling force and a rolling torque change due to steel plate temperature. According to the present embodiment, since the steel plate temperature can be calculated accurately, the various values of a rolling process can also be calculated accurately.

In hot rolling, a state of phase transformation changes in accordance with temperature history of a steel plate and, accordingly, mechanical properties such as strength of a final product vary. Thus, it is extremely important to manage the temperature of the steel plate. In the rolling system 20, the temperature of the steel plate is measured and managed using the first thermometer 5, the second thermometer 6, the third thermometer 11, and the fourth thermometer 13. These radiation thermometers included in the rolling system 20 normally measure a temperature of a center part in the plate-width direction of the top surface 34 of the steel plate. Thus, typically, temperature management of the steel plate is performed using the temperature of the center part in the plate-width direction. A large difference between the temperature of the center part in the plate-width direction and the temperature of an edge part causes only the edge part to have different mechanical properties and is unfavorable. In the present embodiment, the temperature distribution of the steel plate can be accurately calculated including the edge part. The edge heater control unit 100*c* controls power of the edge heater 7 or the amount of applied heat by the edge heater 7 based on the temperature of each rectangular element as calculated by the temperature calculating unit 100*b*. In the present embodiment, by dividing the first region 31 which contains a region to be heated by the edge heater 7 into a plurality of elements also in the plate-width direction, the temperature distribution of the edge part of the steel plate which is heated by the edge heater 7 can be accurately calculated. By controlling power of the edge heater 7 or the amount of applied heat by the edge heater 7 based on such accurate calculation results, power of the edge heater 7 or the amount of applied heat by the edge heater 7 can be controlled in a highly accurate manner so as to reduce the difference between the temperature of the center part in the plate-width direction and the temperature of the edge part.

Second Embodiment

Figure 6:
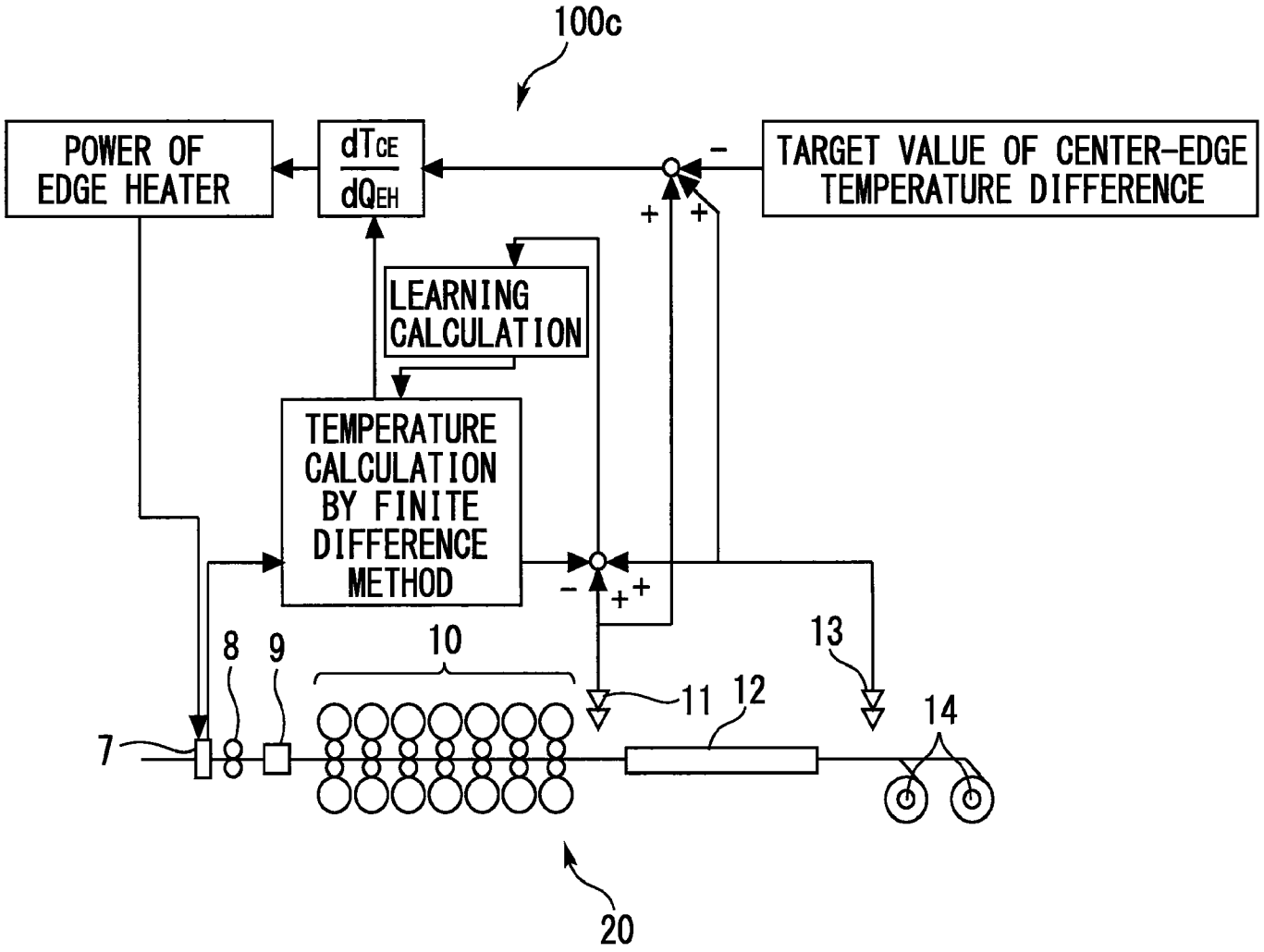
FIG. 6 is a block diagram of an edge heater control unit of a rolling system according to a second embodiment.

Next, while a second embodiment of the present invention will be described with reference to FIGS. 6 and 7, the description will focus on differences from the first embodiment described above and same or equivalent portions will be denoted by the same reference signs and descriptions thereof will be omitted.

The rolling system 20 according to the present second embodiment has an approximately similar equipment configuration to the first embodiment. FIG. 6 is a block diagram of the edge heater control unit 100*c* of the rolling system 20 according to the present second embodiment. In FIG. 6, a part of the equipment included in the rolling system 20 according to the present second embodiment has been omitted.

In the present second embodiment, the edge heater control unit 100*c* executes a step of measuring a temperature difference between a representative temperature of the second region 32 and a representative temperature of the first region 31 of a steel plate at a position on a downstream of the edge heater 7. Hereinafter, this temperature difference will be referred to as a "center-edge temperature difference". The representative temperature of the first region 31 corresponds to a representative temperature of an edge part of the steel plate. The representative temperature of the second region 32 corresponds to a representative temperature of the steel plate other than the edge part or, in other words, a representative temperature of a center part of the steel plate in the plate-width direction. The edge heater control unit 100*c* executes the step of calculating the center-edge temperature difference using the calculation method by the finite difference method described in the first embodiment. The edge heater control unit 100*c* executes a step of learning a correction coefficient based on a measured value of the center-edge temperature difference and a calculated value of the center-edge temperature difference. The edge heater control unit 100*c* executes a step of correcting the calculated value of the center-edge temperature difference using the correction coefficient. The edge heater control unit 100*c* executes a step of controlling power of the edge heater 7 or the amount of applied heat by the edge heater 7 based on the measured value of the center-edge temperature difference, the corrected calculated value of the center-edge temperature difference, and a target value of the center-edge temperature difference. Hereinafter, these steps will be described in detail.

The edge heater 7 is typically installed between the roughing mill 4 and the finishing mill 10. In the present embodiment, the center-edge temperature difference is measured using the third thermometer 11 or the fourth thermometer 13. The center-edge temperature difference can be readily measured by using a scanning radiation thermometer as the third thermometer 11 or the fourth thermometer 13. A scanning radiation thermometer is capable of measuring temperatures at a plurality of points in the plate-width direction on the top surface 34 of the steel plate by scanning a measurement point in the plate-width direction. The third thermometer 11 measures a steel plate temperature on a delivery side of the finishing mill 10. The fourth thermometer 13 measures a steel plate temperature on an entry side of the coiler 14. At these measurement positions, a steel plate surface is stable and, accordingly, temperature measurement is stabilized.

Figure 7:
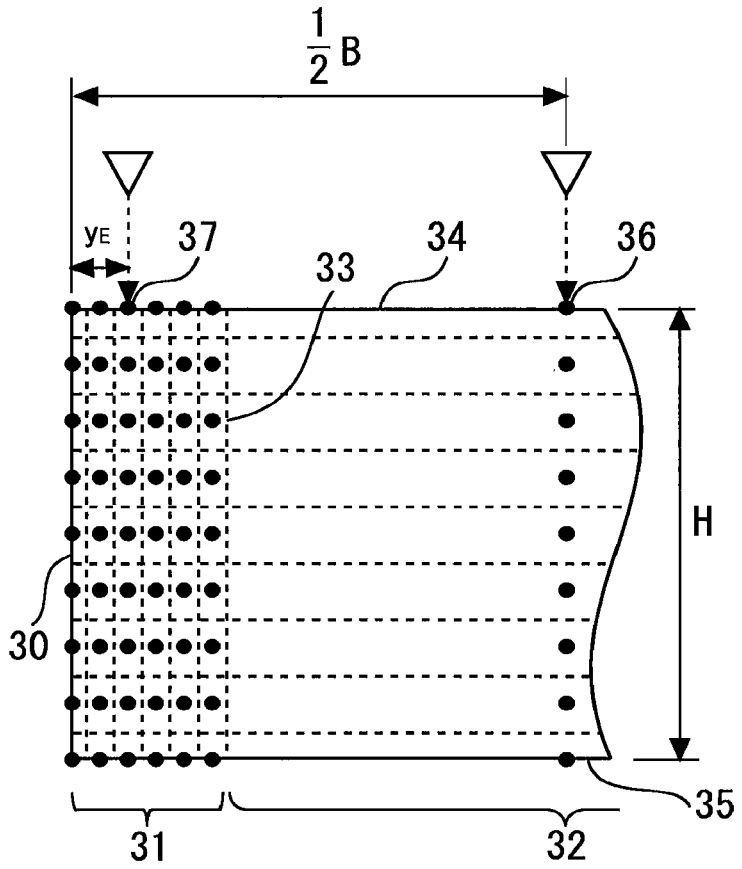
FIG. 7 is a diagram for illustrating measurement positions of a center-edge temperature difference in a plate-width direction.

FIG. 7 is a diagram for illustrating measurement positions of the center-edge temperature difference in the plate-width direction. The scanning radiation thermometer measures temperatures at several positions defined by distances from the side surface 30 of the steel plate and a temperature of a center position of the steel plate in the plate-width direction. In the present embodiment, a temperature at a center position 36 in the plate-width direction of the top surface 34 of the steel plate is used as the representative temperature of the second region 32 of the steel plate. A temperature at a position 37 with a distance of $y_E$ from the side surface 30 of the top surface 34 of the steel plate is used as the representative temperature of the first region 31.

A temperature of a rectangular element calculated using the finite difference method corresponds to an average temperature in the rectangular element. The element dividing unit 100*a* desirably divides the first region 31 such that the position 37 at which the representative temperature of the first region 31 is measured coincides with a center of any rectangular element in the plate-width direction. Accordingly, the calculated value of the center-edge temperature difference can be obtained more accurately. Let us now assume that a center in the plate-width direction of an E-th rectangular element from the side surface 30 among the rectangular elements in the first region 31 coincides with the position 37 at which the representative temperature of the first region 31 is measured. While a case where E=3 is shown in FIG. 7 for the sake of convenience, it is needless to say that E may be 4 or more. In this case, the following is satisfied.

$$y_E=\Delta y_1+\Delta y_2+\ldots+\Delta y_{E-1}+\tfrac{1}{2}\Delta y_E$$

$$T_E^{Cal}=T_{1_j_E} \qquad \text{[Math. 11]}$$

where $T_E^{Cal}$ [K]: calculated value of temperature at position 37 where representative temperature of first region 31 is measured, $T_{1_j_E}$ [K]: calculated value of temperature of $1_j_E$-th element, and $j_E$=E.

When the position 37 at which the representative temperature of the first region 31 is measured does not coincide with a center of any rectangular element in the plate-width direction, $T_E^{Cal}$ can be calculated with high accuracy by linearly interpolating temperatures of adjacent rectangular elements. First, let us assume that the position 37 at which the representative temperature of the first region 31 is measured is between a center in the plate-width direction of a $1_j_{E-1}$-th rectangular element and a center in the plate-width direction of a $1_j_E$-th rectangular element. $\Delta y_{EM}$ denotes a distance from the center in the plate-width direction of the $1_j_{E-1}$-th rectangular element to the position 37. $T_E^{Cal}$ can be calculated by the following equation.

$$T_E^{Cal} = T_{1_jE-1} + \frac{2\cdot\Delta y_{EM}}{\Delta y_{E-1}+\Delta y_E}(T_{1_jE} - T_{1_jE-1}) \quad \text{[Math. 12]}$$

The center-edge temperature difference is represented by the following equation.

$$\Delta_{CE}^{FDT}=T_C^{FDT}-T_E^{FDT} \quad \text{[Math. 13]}$$

where $\Delta T_{CE}^{FDT}$ [K]: center-edge temperature difference, $\Delta T_C^{FDT}$ [K]: representative temperature of second region 32, and $\Delta T_E^{FDT}$ [K]: representative temperature of first region 31.

In the present embodiment, the three values below are used as the center-edge temperature difference $\Delta T_{CE}^{FDT}$.

$\Delta T_{CE_aim}^{FDT}$ [K]: target value of center-edge temperature difference, $\Delta T_{CE_cal}^{FDT}$ [K]: calculated value of center-edge temperature difference using finite difference method, and $\Delta T_{CE_act}^{FDT}$ [K]: measured value (actual value) of center-edge temperature difference measured by third thermometer 11 or fourth thermometer 13.

A calculated value of the representative temperature of the second region 32 corresponds to a calculated value of a temperature of a rectangular element including the top surface 34 of the second region 32 or, in other words, a calculated value of a temperature of a 1_(NW+1)-th element. $T_{1_NW}+1$ [K] denotes the calculated value of the temperature of the 1_(NW+1)-th element. The calculated value of the center-edge temperature difference is represented by the following equation.

$$\Delta T_{CE_cal}^{FDT}=T_{1_NW+1}-T_E^{Cal}$$

The edge heater control unit 100*c* controls power of the edge heater 7 or the amount of applied heat by the edge heater 7 such that the calculated value and the measured value of the center-edge temperature difference described above transition to a vicinity of the target value of the center-edge temperature difference. The target value of the center-edge temperature difference is desirably set to, for example, around 20 K.

Since there is distance between the edge heater 7 and the third thermometer 11 or the fourth thermometer 13, there may be cases where the measured value of the center-edge temperature difference is not easily brought close to the target value with a method involving direct feedback-control of the edge heater 7 based on the measured value of the center-edge temperature difference. In contrast, in the present embodiment, by controlling the edge heater 7 using also the calculated value of the center-edge temperature difference, the measured value of the center-edge temperature difference can be brought close to the target value with high accuracy. In addition, in the present embodiment, by learning a correction coefficient for correcting the calculated value of the center-edge temperature difference, the measured value of the center-edge temperature difference can be brought close to the target value with even higher accuracy.

$Z_{TE}$ denotes the correction coefficient. The correction coefficient $Z_{TE}$ represents a ratio between the measured value and the calculated value of the center-edge temperature difference. The correction coefficient $Z_{TE}$ is calculated by the following equation.

$$Z_{TE} = \frac{\Delta T_{CE_act}^{FDT}}{\Delta T_{CE_cal}^{FDT}} \quad \text{[Math. 14]}$$

The correction coefficient $Z_{TE}$ calculated by the equation given above is smoothed by the following equation and then updated and saved in a lookup table or the like.

$$Z_{TE}^{UPD}=(1-\alpha)\cdot Z_{TE}^{TBL}+\alpha\cdot Z_{TE} \quad \text{[Math. 15]}$$

where $Z_{TE}^{UPD}$: updated and saved correction coefficient, $Z_{TE}^{TBL}$: correction coefficient read from table prior to update, and $\alpha$: prescribed coefficient satisfying $0<\alpha<1$.

When calculating the center-edge temperature difference of a next steel plate using the finite difference method, a calculated value is corrected according to the following equation using the updated and saved correction coefficient $Z_{TE}^{UPD}$.

$$\Delta T_{CE_cal}^{FDT\prime}=Z_{TE}^{UPD}\cdot\Delta T_{CE_cal}^{FDT} \quad \text{[Math. 16]}$$

where $\Delta T'_{CE_cal}^{FDT}$ denotes a corrected calculated value of the center-edge temperature difference. In the following description, $\Delta T'_{CE_cal}^{FDT}$ will be simply written as $\Delta T_{CE_cal}^{FDT}$ for convenience sake.

In the present embodiment, a learning calculation such as that described above is continuously repeated for each steel plate. As a result, accuracy of the calculated value of the center-edge temperature difference can be increased.

Next, a method of controlling power of the edge heater 7 or the amount of applied heat by the edge heater 7 will be described. First, a ratio of change in the center-edge temperature difference with respect to a change in the amount of applied heat by the edge heater 7 is calculated using the finite difference method by the following equation. Moreover, in this calculation, a calculated value is corrected by the correction coefficient described earlier.

$$\frac{dT_{CE}}{dQ_{EH}} = \frac{\Delta T_{CE_cal}^{FDT}(Q_{EH}+\Delta Q_{EH}) - \Delta T_{CE_cal}^{FDT}(Q_{EH})}{\Delta Q_{EH}} \quad \text{[Math. 17]}$$

where $dT_{CE}/dQ_{EH}$: ratio of change in center-edge temperature difference when amount of applied heat of edge heater 7 is changed from $Q_{EH}$ to $(Q_{EH}+\Delta Q_{EH})$, $\Delta T_{CE_cal}^{FDT}(Q_{EH}+\Delta Q_{EH})$: calculated value of center-edge temperature difference calculated using finite difference method when amount of applied heat of edge heater 7 is $(Q_{EH}+\Delta Q_{EH})$, and $\Delta T_{CE_cal}^{FDT}(Q_{EH})$: calculated value of center-edge temperature difference calculated using finite difference method when amount of applied heat of edge heater 7 is $Q_{EH}$.

Subsequently, a correction amount $\Delta Q_{EH}^{MOD}$ of the amount of applied heat by the edge heater 7 necessary for eliminating a deviation between the measured value and the target value of the center-edge temperature difference is calculated according to the following equation.

$$\Delta Q_{EH}^{MOD} = \frac{\Delta T_{CE_act}^{FDT} - \Delta T_{CE_aim}^{FDT}}{\frac{dT_{CE}}{dQ_{EH}}} \quad \text{[Math. 18]}$$

The edge heater control unit 100*c* controls power of the edge heater 7 or the amount of applied heat by the edge heater 7 based on the correction amount $\Delta Q_{EH}^{MOD}$ calculated by the equation given above. For example, the edge heater control unit 100*c* controls power of the edge heater 7 or the amount of applied heat by the edge heater 7 for heating a next steel plate using the following equation.

$$Q_{EH}' + Q_{EH}^{TBL} + \Delta Q_{EH}^{MOD} \quad \text{[Math. 19]}$$

where $Q_{EH}^{TBL}$: amount of applied heat of edge heater 7 read from lookup table or the like, and $Q'_{EH}$: corrected amount of applied heat of edge heater 7 with respect to next steel plate.

The edge heater control unit 100*c* transmits to the edge heater 7 a signal for controlling power of the edge heater 7 or the amount of applied heat by the edge heater 7 so that the amount of applied heat by the edge heater 7 for heating a next steel plate is corrected as described above. In addition, the edge heater control unit 100*c* desirably updates the lookup table of the amount of applied heat by the edge heater 7 based on the amount of applied heat by the edge heater 7 having been corrected as described above.

According to the method described above, a measured value (an actual value) of the center-edge temperature difference can be brought close to a target value with high accuracy. According to the present embodiment, a difference between a temperature of a center part in the plate-width direction and a temperature of an edge part of a steel plate can be reduced in a more reliable manner. As a result, quality of the steel plate including the edge part can be improved.

REFERENCE SIGNS LIST

1 slab heating furnace
2 high-pressure descaling apparatus
3 edger
4 roughing mill
5 first thermometer
6 second thermometer
7 edge heater
8 crop shear
9 finishing-entry-side descaling apparatus
10 finishing mill
11 third thermometer
12 runout laminar spray cooling apparatus
13 fourth thermometer
14 coiler
20 rolling system
30 side surface
31 first region
32 second region
33 region boundary
34 top surface
35 bottom surface
36 center position
37 position at which a representative temperature of a first region is measured
100 controller
100*a* element dividing unit
100*b* temperature calculating unit
100*c* edge heater control unit
101 processor
104 receiving apparatus
105 transmitting apparatus
106 hard disk drive
200 bus

The invention claimed is:

1. A temperature calculation method, comprising:

dividing a cross section perpendicular to a longitudinal direction of a steel plate to be hot-rolled into a plurality of rectangular elements;

calculating a temperature of each of the rectangular elements using a finite difference method; and controlling power of an edge heater that heats an edge part of the steel plate or an amount of applied heat by the edge heater, based on the calculated value of the temperature, wherein a first region that includes the edge part of the cross section is divided such that a plurality of the rectangular elements are lined up in a plate-thickness direction and such that a plurality of the rectangular elements are lined up in a plate-width direction, and a second region that includes a center of the cross section and is wider than the first region is divided such that a plurality of the rectangular elements are lined up in the plate-thickness direction but the second region is not divided in the plate-width direction.

2. The temperature calculation method according to claim 1, wherein a length in the plate-width direction of each of the rectangular elements in the first region becomes smaller from a position close to the second region toward a side surface of the steel plate.

3. The temperature calculation method according to claim 1, wherein in a calculation using the finite difference method when the steel plate is water-cooled, a value obtained by multiplying a value of a heat flux or a heat transfer coefficient due to water cooling for a top surface of the steel plate by an adjustment coefficient larger than 0 and smaller than 1 is used as a value of a heat flux or a heat transfer coefficient due to water cooling for a side surface of the steel plate.

4. A heating control method, comprising:

measuring a temperature difference between a representative temperature of the second region and a representative temperature of the first region at a position on a downstream of the edge heater;

calculating the temperature difference using the temperature calculation method according to claim 1; and controlling power of the edge heater or an amount of applied heat by the edge heater, based on the measured value of the temperature difference, the calculated value of the temperature difference, and a target value of the temperature difference.

5. The heating control method according to claim 4, further comprising:

learning a correction coefficient based on the measured value and the calculated value; and correcting the calculated value with the correction coefficient.

6. A temperature calculation apparatus, comprising a controller to:

divide a cross section perpendicular to a longitudinal direction of a steel plate to be hot-rolled into a plurality of rectangular elements;

calculate a temperature of each of the rectangular elements using a finite difference method; and control power of an edge heater that heats an edge part of the steel plate or an amount of applied heat by the edge heater, based on the calculated value of the temperature, wherein a first region that includes the edge part of the cross section is divided such that a plurality of the rectangular elements are lined up in a plate-thickness direction and such that a plurality of the rectangular elements are lined up in a plate-width direction, and a second region that includes a center of the cross section and is wider than the first region is divided such that a plurality of the rectangular elements are lined up in the plate-thickness direction but the second region is not divided in the plate-width direction.

7. The temperature calculation apparatus according to claim 6, wherein a length in the plate-width direction of each of the rectangular elements in the first region becomes smaller from a position close to the second region toward a side surface of the steel plate.

8. The temperature calculation apparatus according to claim 6, wherein in a calculation using the finite difference method when the steel plate is water-cooled, a value obtained by multiplying a value of a heat flux or a heat transfer coefficient due to water cooling for a top surface of the steel plate by an adjustment coefficient larger than 0 and smaller than 1 is used as a value of a heat flux or a heat transfer coefficient due to water cooling for a side surface of the steel plate.

9. A heating control apparatus, comprising:

the temperature calculation apparatus according to claim 6; and a thermometer that measures a temperature difference between a representative temperature of the second region and a representative temperature of the first region at a position on a downstream the edge heater, wherein the temperature calculation apparatus calculates the temperature difference, and the controller controls power of the edge heater or an amount of applied heat by the edge heater, based on the measured value of the temperature difference, the calculated value of the temperature difference, and a target value of the temperature difference.

10. The heating control apparatus according to claim 9, wherein the controller is to:

learn a correction coefficient, based on the measured value and the calculated value; and correct the calculated value with the correction coefficient.

* * * * *